US011986743B2

(12) United States Patent
Laffin

(10) Patent No.: US 11,986,743 B2
(45) Date of Patent: May 21, 2024

(54) GUIDED BOAT WITH EXTERNAL DISCRETE YAW CONTROL

(71) Applicant: DISNEY ENTERPRISES, INC., Burbank, CA (US)

(72) Inventor: Kristopher M. Laffin, Los Angeles, CA (US)

(73) Assignee: Disney Enterprises, Inc., Burbank, CA (US)

( * ) Notice: Subject to any disclaimer, the term of this patent is extended or adjusted under 35 U.S.C. 154(b) by 872 days.

(21) Appl. No.: 17/084,143

(22) Filed: Oct. 29, 2020

(65) Prior Publication Data

US 2022/0134244 A1 May 5, 2022

(51) Int. Cl.
*A63G 3/00* (2006.01)
*A63G 21/18* (2006.01)

(52) U.S. Cl.
CPC ..... *A63G 3/00* (2013.01); *A63G 21/18* (2013.01)

(58) Field of Classification Search
CPC ..... A63G 3/00; A63G 21/00; A63G 21/18
See application file for complete search history.

(56) References Cited

U.S. PATENT DOCUMENTS 1,563,855 A 12/1925 Held
3,003,430 A 10/1961 Hamel
3,113,528 A 12/1963 Morgan et al.
3,404,635 A 10/1968 Bacon et al.
4,149,469 A 4/1979 Bigler
4,337,704 A 7/1982 Becker et al.
4,392,434 A 7/1983 Durwald et al.
5,295,442 A 3/1994 Carpenter
5,473,990 A 12/1995 Anderson et al.
5,613,443 A 3/1997 Ariga et al.
5,732,635 A * 3/1998 McKoy ..... B63B 1/16 104/73
5,775,226 A 7/1998 Futami et al.
5,860,364 A 1/1999 McKoy
6,170,403 B1 * 1/2001 Behringer ..... A63G 7/00 104/73
6,237,499 B1 * 5/2001 McKoy ..... B63B 1/16 104/70
6,354,223 B2 3/2002 McKoy
6,354,448 B1 3/2002 Ramne
6,533,670 B1 3/2003 Drobnis
6,580,541 B1 6/2003 Yamashita et al.
(Continued)

*Primary Examiner* — S. Joseph Morano
*Assistant Examiner* — Cheng Lin
(74) *Attorney, Agent, or Firm* — Dorsey & Whitney LLP

(57) ABSTRACT

A water ride system configured to provide passengers of boats new and exciting experiences via enhanced storytelling opportunities. The water ride system is designed to allow ride designers to provide 2-dimensional guiding of the boat traveling in a flume in a direction of travel (DOT) coinciding with the direction of water flowing in the flume. The water ride system uses a combination of a guideway (or track) within the flume and a new guide bogie. The guide bogie has a square body and four corner-mounted guide wheels, and the bogie is mounted on the bottom of the boat so as to ride within the guideway to provide guided boats with various headings. Specifically, the boats can be oriented in many different directions rather than having a single fixed orientation, such as with a front of the boat facing in the DOT, as was the case with traditional water rides.

33 Claims, 9 Drawing Sheets

(56) References Cited

U.S. PATENT DOCUMENTS

| | | | | |
|---|---|---|---|---|
| 6,592,374 | B1 | 7/2003 | Kim | |
| 6,629,501 | B2 | 10/2003 | McKoy | |
| 6,860,209 | B2 | 3/2005 | McKoy | |
| 6,971,317 | B2 | 12/2005 | McKoy | |
| 7,437,998 | B2 | 10/2008 | Burger et al. | |
| 8,091,483 | B1 * | 1/2012 | Sumner | A63G 3/00 104/73 |
| 8,375,864 | B1 * | 2/2013 | Crawford | A63G 3/02 104/73 |
| 10,625,168 | B2 * | 4/2020 | Laffin | A63G 3/00 |
| 11,338,212 | B2 * | 5/2022 | Laffin | A63G 21/04 |
| 2006/0130698 | A1 | 6/2006 | Burger et al. | |
| 2006/0219124 | A1 | 10/2006 | Jordan | |
| 2007/0207869 | A1 | 9/2007 | Hunter | |
| 2018/0339234 | A1 * | 11/2018 | Vance | A63G 31/08 |

* cited by examiner

GUIDED BOAT WITH EXTERNAL DISCRETE YAW CONTROL

BACKGROUND

1. Field of the Description

The present description relates, in general, to passenger boats such as round rafts and their use in water-based rides in amusement parks, theme parks, and water parks, and, more particularly, to a water ride (or water ride system) adapted to provide two-dimensional (2D) guidance of a passenger boat within a flume as it travels under the forces of flowing water in a direction of travel ("DOT").

2. Relevant Background

In amusement parks, water parks, resorts, and many other settings, entertainment is provided that involves passengers riding on boats in still and moving water. For example, resorts may provide passenger boats in the form of rafts, kayaks, and paddleboats to their guests to allow them to play in the water. In amusement parks, many rides have been designed and implemented that provide a river boat or raft experience. While water rides are some of the most popular park rides, visitors to these parks are continuing to expect more variety and differing entertainment from these rides.

In most raft-based rides, passengers enter a non-motorized boat, such as a round raft, in a station. Upon release from the station, water flowing, often under the force of gravity, in a man-made channel or flume moves the passenger boats down the channel and may even cause the boat to flow over rapids and down steep chutes. Excitement and thrill are added to these water rides by introducing the risk that passengers may get soaked with water or at least be sprayed and by simulating a wilderness river raft trip by allowing the raft to move from side-to-side across the width of the flume and to freely rotate. These rides provide a unique experience as the vehicles can rotate 360 degrees. However, the orientation is not controlled, which makes it difficult for ride designers as they must assume the passengers can be looking in any direction. As a result, most raft rides are designed to only use show elements and storytelling features in a very limited manner.

Conversely traditional guided boat rides use a track in the flume and side guides or center guides on the boat to guide the boat in a predictable direction and orientation along the length of the track. FIG. 1 illustrates a portion of a traditional center guide water ride 100. As shown, the water ride 100 includes a flume 110 in which a boat 120 with a hull 122 configured for passengers (not shown) floats upon water 102 with a water level 106. The bottom surface 124 of the boat hull 122 is submerged below the water level 106, and the boat 120 floats under the forces of the moving water in a direction of travel (DOT) 104 that coincides with the direction of flow of the water 102. The flume 110 includes a pair of spaced-apart vertical sidewalls 112, 114 with inner surfaces 113, 115 containing and directing the water 102 to flow along a ride path along with an upper surface 117 of the bottom wall 116 of the flume 110.

The ride system 100 further includes a guide track 140 that is mounted on the upper surface 117 of the bottom wall 116 of the flume 110. The guide track 140 includes a pair of spaced-apart sidewalls 142, 144 with inward-facing contact or guide surfaces 143, 145. The boat 120 includes a pair of post and wheel assemblies mounted on the bottom hull surface 124 in the front and rear portions of the boat, with the front view of system 100 in FIG. 1 providing a view of the front guide post 130 and the front guide wheel 134 that is pivotally mounted on this post 130. During operations of the ride 100, the front guide wheel 134 (and rear guide wheel not shown in FIG. 1) are received within the track 140 with the wheel 134 continuously or intermittently contacting and rolling upon the wall surfaces 143, 145.

Traditional guided-boat rides, such as ride 100 of FIG. 1, use a flume to guide a boat in a predictable direction and in a known and fixed orientation (e.g., with the boat facing downstream or forward) throughout the ride experience. Although these rides can be used by ride designers and operators to tell a great story with show features along the flume, the fact that the boat always faces one direction limits the creativity of the ride designers. The story and show effects must be designed with the understanding that the passengers' views cannot be changed along the ride path and will always be in one direction (e.g., in the DOT) for the length of the ride.

Hence, there remains a need for a new water ride design that provides improvements over existing raft and guided-boat rides. Particularly, it is desirable for the new ride designs to enhance the ability for a ride designer to present a creative and exciting story along the ride path that makes the water ride experience less predictable for park visitors.

SUMMARY

The inventor recognized that there was a need for a water ride (or water ride system) that provided passengers of boats, rafts, and the like (with all such watercraft labeled as "a boat" or "passenger boat" herein) new and exciting experiences via enhanced storytelling opportunities. Specifically, there was a need for a water ride system designed to allow ride designers to provide 2-dimensional guiding of the boat traveling in a flume in a DOT coinciding with the direction of water flowing in the flume. To this end, the new water ride system uses a combination of a guideway (or track) within the flume and a new guiding bogie, with a square body and four corner-mounted guide wheels, that is mounted on the bottom of the boat and that rides within the guideway to provide guided boats (to control their position within the flume relative to flume sidewalls) with external yaw control. Specifically, the boats can be oriented to face different directions rather than having a single fixed orientation (e.g., with a front of the boat facing in the DOT) as is the case with traditional water rides such as the ride 100 of FIG. 1.

More particularly, a water ride system is provided that includes a flume for receiving and containing flowing water. The flume includes first and second sidewalls and a bottom wall extending between lower edges of the first and second sidewalls. In the ride system within the flume, a boat is provided with a hull, and, during system operations, the boat travels with the flowing water in a direction of travel (DOT) coinciding with a direction of flow of the flowing water. Significantly, the system also includes a guide bogie on a lower surface of the hull of the boat, and a body of the guide bogie, which is at least partially submerged in the flowing water, pivotally supports a plurality of guide wheels. Further, the system includes a guideway provided on an upper surface of the bottom wall of the flume, with the guideway including a pair of spaced-apart contact surfaces (e.g., provided by spaced apart vertical sidewalls). During system operations, the guide wheels at least periodically contact and roll upon the contact surfaces of the guideway when the body of the guide bogie is received within the guideway while the boat travels along a ride path defined by the guideway in the DOT.

The body has four sides with equal lengths to define a square cross sectional shape of the body. The guidewheels extend outward a distance from each corner of the body, and the guide wheels are supported on the body to have a vertical rotation axis extending through or near a corner of the body so that a pitch between adjacent pairs of the guidewheels has a single value (or the pitch is the same between guide wheels). The guideway is configured such that the body of the guide bogie is limited from rotation by the contact surfaces and an orientation of the hull is retained in the guideway. Particularly, the flume includes a first section in which the orientation of the hull is a first one of forwards, backwards, left sideways, and right sideways and a second section in which the orientation of the hull is a second one of forwards, backwards, left sideways, and right sideways that differs from the first one or first orientation (but, then, in each section the orientation is retained as the boat travels in the DOT).

In some implementations, the guideway includes a secondary guideway, and the water ride system further includes a boat rotation assembly rotating the body of the guide bogie 90 degrees within the secondary guideway to change an orientation of the hull from a first orientation upstream of the secondary guideway to a second orientation downstream of the secondary guideway. In some of these implementations, the boat rotation assembly is passive. For example, the boat rotation assembly may include a guide member spaced apart from one of the contact surfaces defining a wheel passageway between the guide member and the one of the contact surfaces, the wheel passageway is sized to receive a leading one of the guide wheels of the guide bogie, and the wheel passageway defines a travel path for the received leading one of the guide wheels with a bend causing the body of the bogie to rotate under a momentum of the boat, and the force of the water flow, to travel in the DOT in the flume. Further, the boat rotation assembly may include at least one recessed surface in the contact surfaces for receiving one or more of the guide wheels during rotation of the body of the guide bogie in the secondary guideway. In the same or other embodiments, the boat rotation assembly further includes a plurality of devices in the wheel passageway for contacting the received leading one of the guide wheels configured to slow the speed of travel of the received leading one of the guide wheels in the wheel passageway leading to the rotation of the boat around this guide wheel.

In some implementations, the boat rotation assembly is active or mechanized. For example, the boat rotation assembly may include an arm rotatable by an actuator from a first position to position a surface of the arm into the secondary guideway into a path of a leading one of the guide wheels. The arm acts to halt or slow (or capture) the leading one of the guide wheels so as to cause the body of the guide bogie to rotate around the captured wheel in the secondary guideway due to the boat momentum and force of the water. Once the boat has fully rotated, the arm is rotated or moved by the actuator to a second position to move the surface of the arm out of the path of the leading one of the guide wheels, whereby the leading one of the guide wheels is released to flow in the DOT.

DETAILED DESCRIPTION OF THE PREFERRED EMBODIMENTS

Briefly, the following description describes a water ride system adapted to provide external yaw control of a plurality of guided passenger boats. The boats in the new ride system can be oriented in many different directions other than the direction of travel and allow these orientations to change during the course of the ride or along its ride path.

Figure 1:
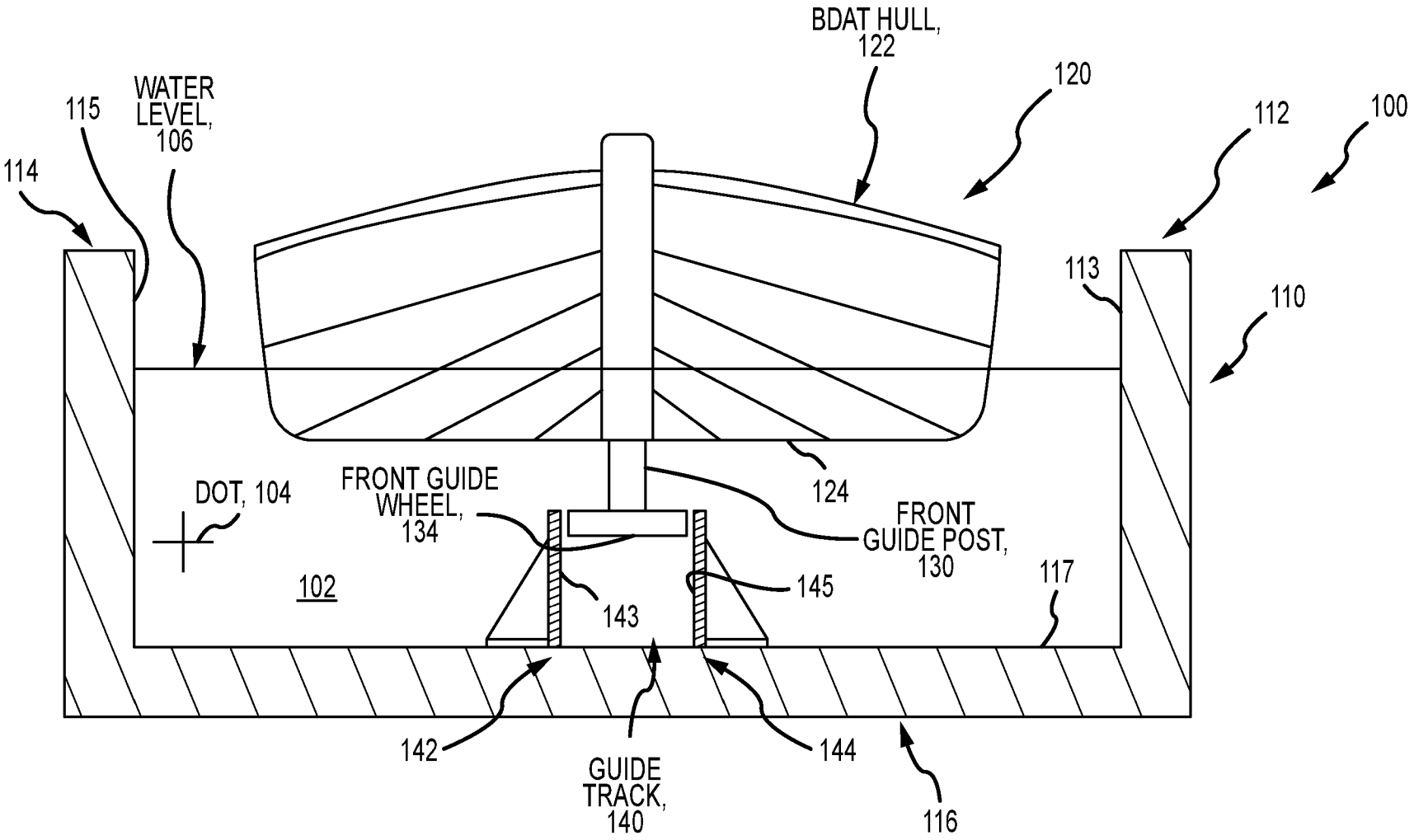
FIG.1 (PRIOR ART)
FIG. 1 is a sectional view of a conventional guided boat ride showing a traditional center guided passenger boat being guided in a one-dimensional manner within a flume.

As discussed with reference to the ride 100 of FIG. 1, prior boat rides have used centrally positioned guide posts with guide wheels and a guideway or track under the boat. In combination, these were used to direct the boat on a specified track layout. The guide posts and wheels have been mounted to the bottom of the boat at the front and rear to ensure the orientation of the boat is always controlled to be in the direction of travel (DOT) of the boat within the ride's flume. Hence, these prior water rides provided a 1-dimensional guide system without any possibility of orientation changes along the length of the flume.

In contrast, the new water ride system design provides a 2-dimensional guiding system for passenger boats as they travel under the forces of water (e.g., for non-motorized boats) along a ride path defined by a flume. To this end, the boat in the new water ride system includes a multi-wheeled guide bogie mounted or provided on a lower surface or portion of its hull, and this bogie mates with and rides within a guideway or track provided in or defined by recessed surfaces (e.g., slots or grooves) in opposite sidewalls of the flume.

Figure 2A:
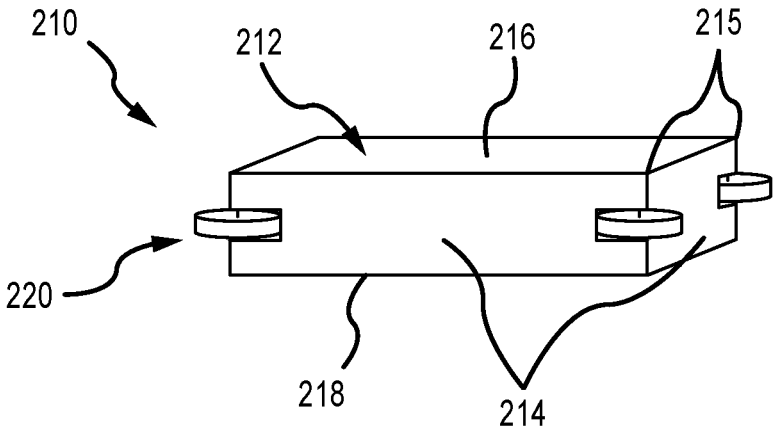
FIGS. 2A and 2B are perspective and top views, respectively, of a square guiding bogie for passenger boats of the water ride systems of the present description.
Figure 2B:
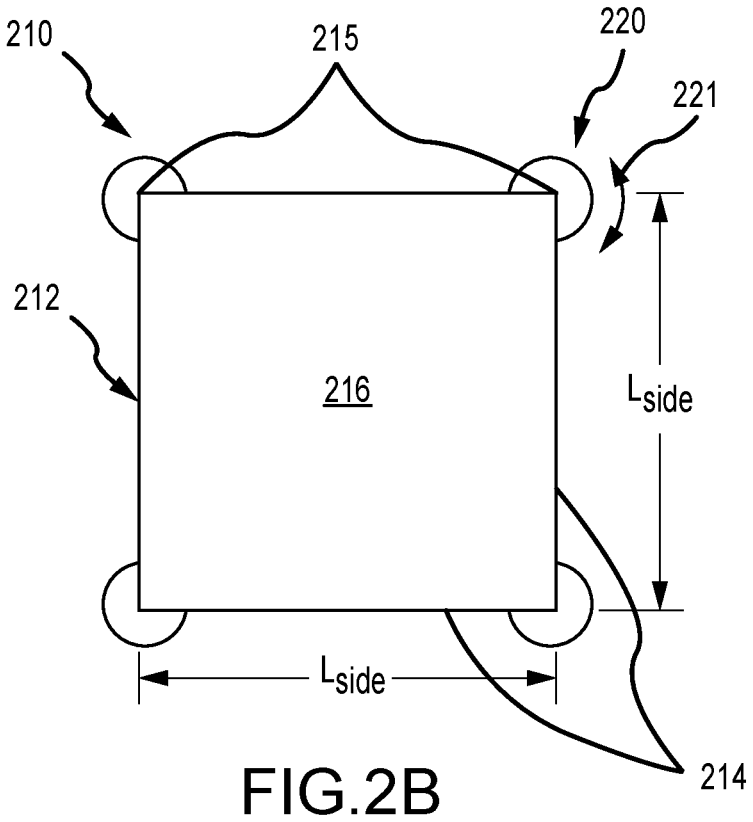

FIGS. 2A and 2B are perspective and top views, respectively, of a square guiding bogie 210 for passenger boats of the water ride systems of the present description (as seen beginning with FIG. 3A discussed below). The bogie 210 includes a body 212 with a square-cross sectional shape (when cut by a horizontal plane). In this regard, the body 212 includes four rectangular sides 214, and pairs of these sides 214 meet at the four corners 215 of the body 212. The top and bottom sides 216 and 218 are square shaped with their edges mating with edges of the rectangular sides 214 (which may themselves be square shaped in some embodiments so that the body is box shaped). In other embodiments, the body 212 is a shape other than square with the wheels still being supported in a square pattern.

Figure 4:
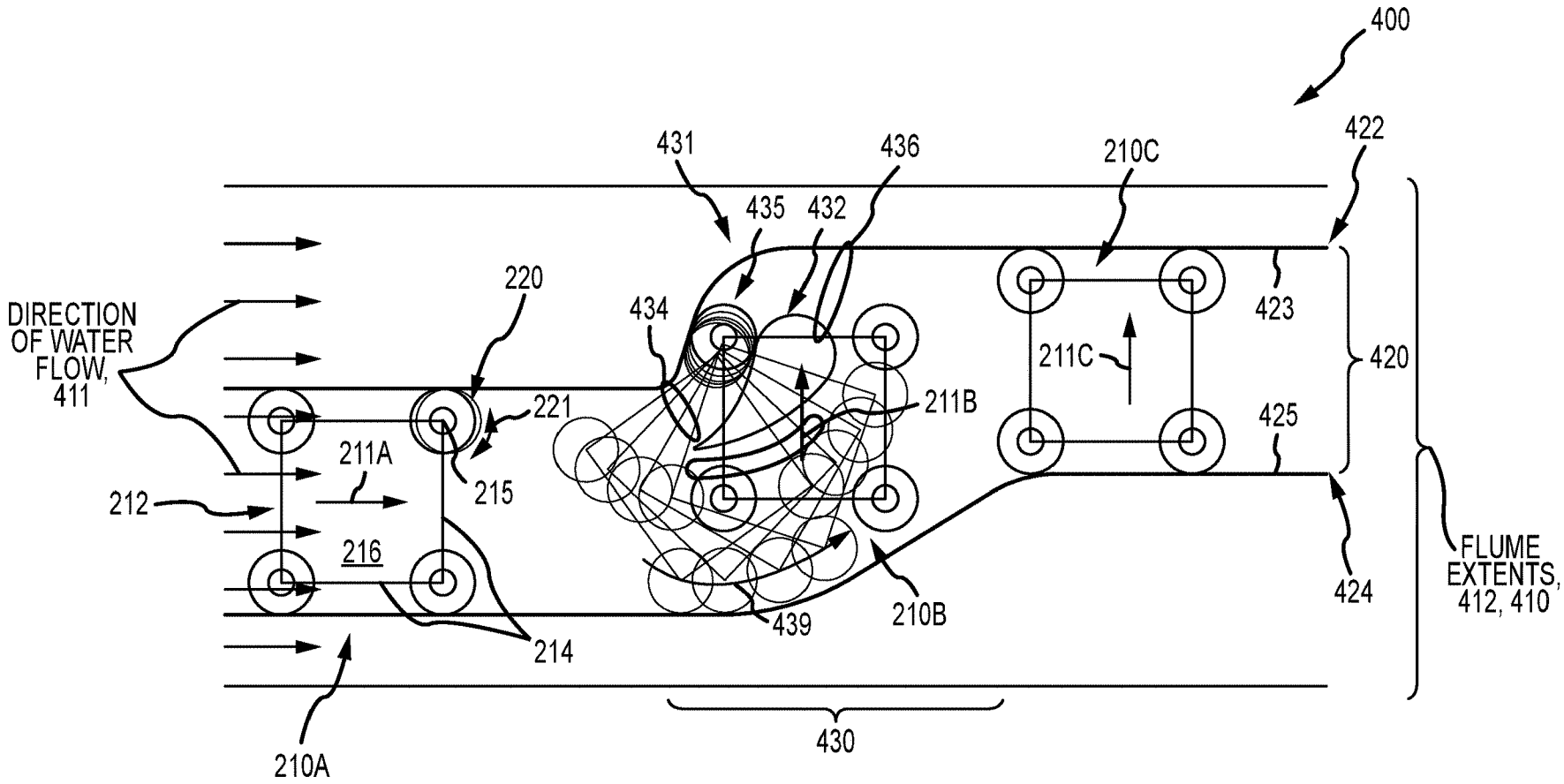
FIG. 4 illustrates a section of a flume of a water ride system of the present description such as those shown in FIGS. 3A-3F that includes a boat rotation assembly with a secondary guideway or track, within the main guideway or track, that is designed to passively rotate or guide the boat from a first orientation to a second orientation using water flow.
Figure 5:
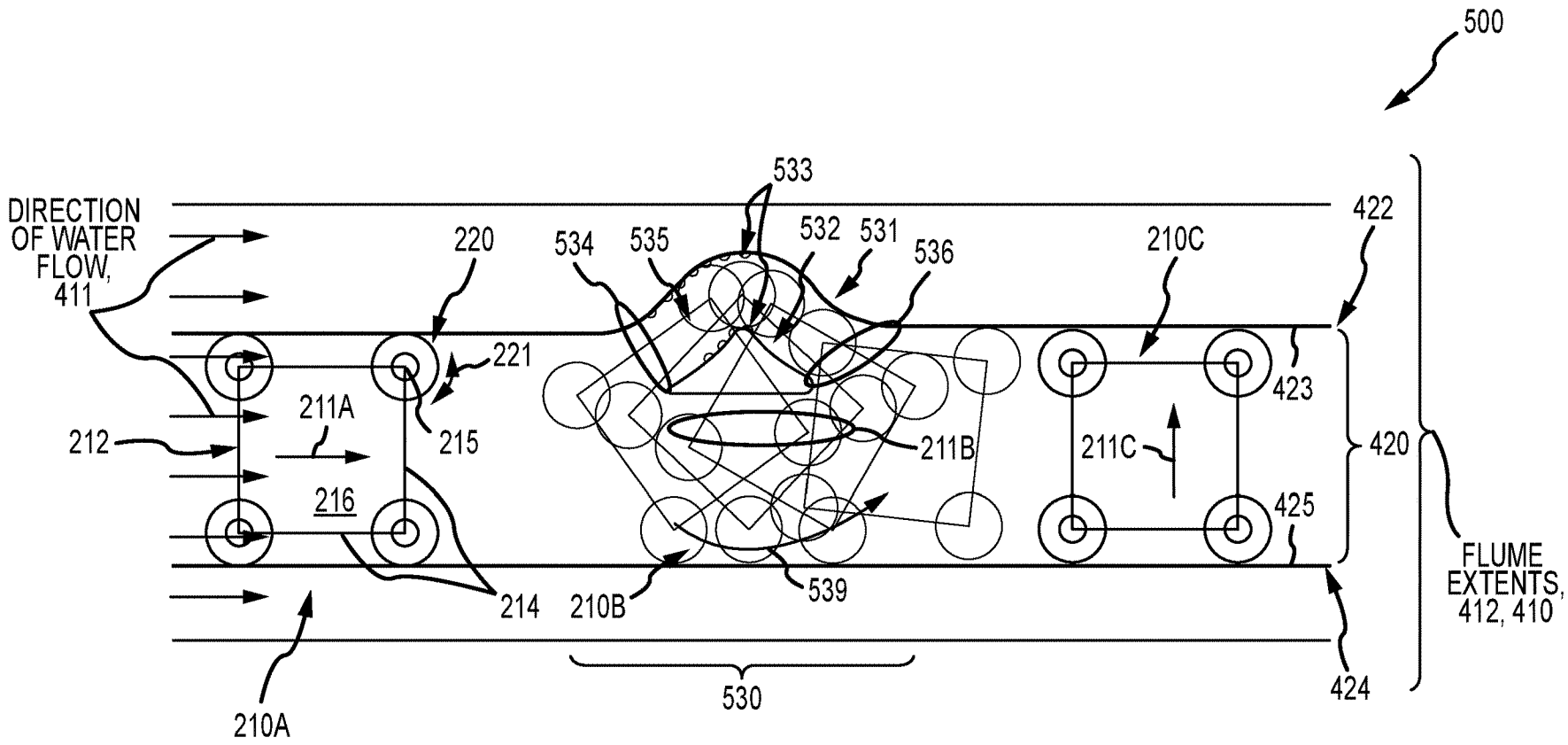
FIG. 5 illustrates another section of a flume of a water ride system, such as those shown in FIGS. 3A-3F, that includes an alternative boat rotation assembly with a secondary guideway or track combined with one or more devices configured to slow movement of a wheel of the guide bogie to passively rotate or guide the boat from a first orientation to a second orientation using water flow and speed reduction.
Figure 6:
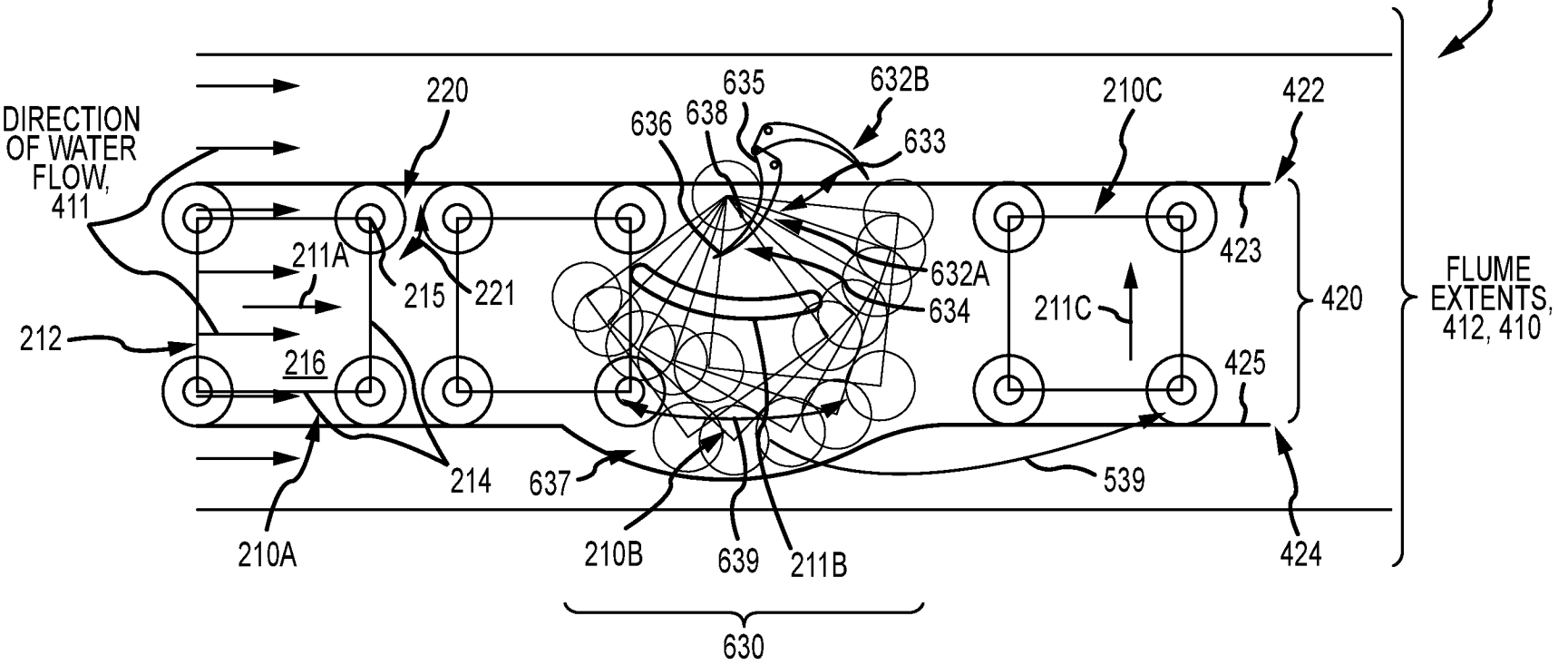
FIG. 6 illustrates another section of a flume of a water ride system, such as those shown in FIGS. 3A-3F, that includes a catch-and-release boat rotation assembly to actively rotate or guide the boat from a first orientation to a second orientation.

The body 212 may be formed of a metal (such as aluminum, stainless steel, and the like), a hard and durable plastic, or other material that is useful in water environments as the bogie 210 will be submerged in the water of a flume during a ride system's operations. The dimensions of the body 212 can vary widely to practice the invention and typically will be selected to suit the boat hull width and length (e.g., be less than these dimensions to hide its presence in the ride system), and the body 212 may be solid but more typically will be formed to offer less drag (or a desired amount of drag) in the flume (such as of porous sheets and/or with water flow passageways passing through) and to also provide passageways for system components used to rotate the boat (as shown in FIGS. 4-6.

The square guiding bogie 212 further includes four guide wheels 220 that are supported upon the body 212 so as to be able to freely rotate in either direction as shown with arrow 221. The guide wheels 220 may be supported so as to have their vertical rotational axes coinciding with or being relatively near to (e.g., within 12 inches) the corners or corner edges 215 of the body 212. In the embodiment illustrated in FIG. 2, the top and bottom sides 216 and 218 are square and have equal sides such that the pitch between the guide wheels 220 is equal or the same. An alternative configuration (not shown but understood from those provided) that would work with the turning devices would have the four wheels mounted on posts below the square guiding bogie. This would ensure that the track would not hit the bogie as it rotates.

The wheels 220 are sized to extend outward a distance from the corners 215 (e.g., 3 to 6 inches or more as measured diagonally outward from each of the corners 215 of the body 212 of the bogie 210) so as to provide mating or contact surfaces with a flume's guideway or track, and the wheels 220 may include rubber, plastic, or other material tires on a rim or hub to provide a resilient contact member and traction with the guideway or track surfaces during ride system operations. The wheels 220 may have a width of 3 to 6 inches or more to further facilitate interaction with the guideway/track surfaces. The length, $L_{Side}$, of a side edge of the top and bottom sides 216 and 218 (or width of the body 212) when combined with the distance the guide wheels 220 extend outward is selected to be suited for the width of the guide way or track (e.g., be less than this width but yet ensure adequate engagement between the wheels 220 and inner or contact surfaces of the guideway/track (e.g., outer dimensions of bogie 210 as measured between outer extents of the guide wheels 220 may be several inches (or more) less than the minimum width of the guideway such that a boat may move some amount side-to-side in the flume as it is being guided, while also limiting the rotation of the boat)).

The design of the bogie 210 with a square body 212 and with guide wheels 220 on all four corners 215 is useful for achieving 2-dimensional guiding in a water ride system, when it is coupled with a wayside guideway with a width that matches (is larger by some predefined relatively small amount) that of the guiding square defined by the body 212. A boat with the bogie 210 attached can be guided in four different boat orientations (i.e., forwards (or forward facing), left sideways, right sideways, and backwards), and this multi-directional orientation of a guided boat is achievable or possible because the pitch is the same or equal between the four guide wheels 220 (as measured between vertical pivot axes of adjacent pairs of the wheels 220 (or as being the length, $L_{Side}$, of the body 212 in some embodiments)). Since the wheel pitch is the same no matter the orientation of the vehicle/boat with the bogie 210, the vehicle/boat can now be guided so as to change orientation along the system's ride path without changing the track or guideway (e.g., along the length of the flume as the boat floats in the system's flume). This change in orientation can be done, for example, using external rotation devices or via strategically designed track transitions (with examples shown in FIGS. 4-6).

The 2-dimensional guiding system can be used on two of the most popular types of water ride systems presently in use in parks, i.e., guided boat systems and raft ride systems, so as to further storytelling capability of both of these types of park attractions. FIGS. 3A-3B illustrate end views of a raft ride system 300 and a boat ride system 350, respectively, of the present description.

Figure 3A:
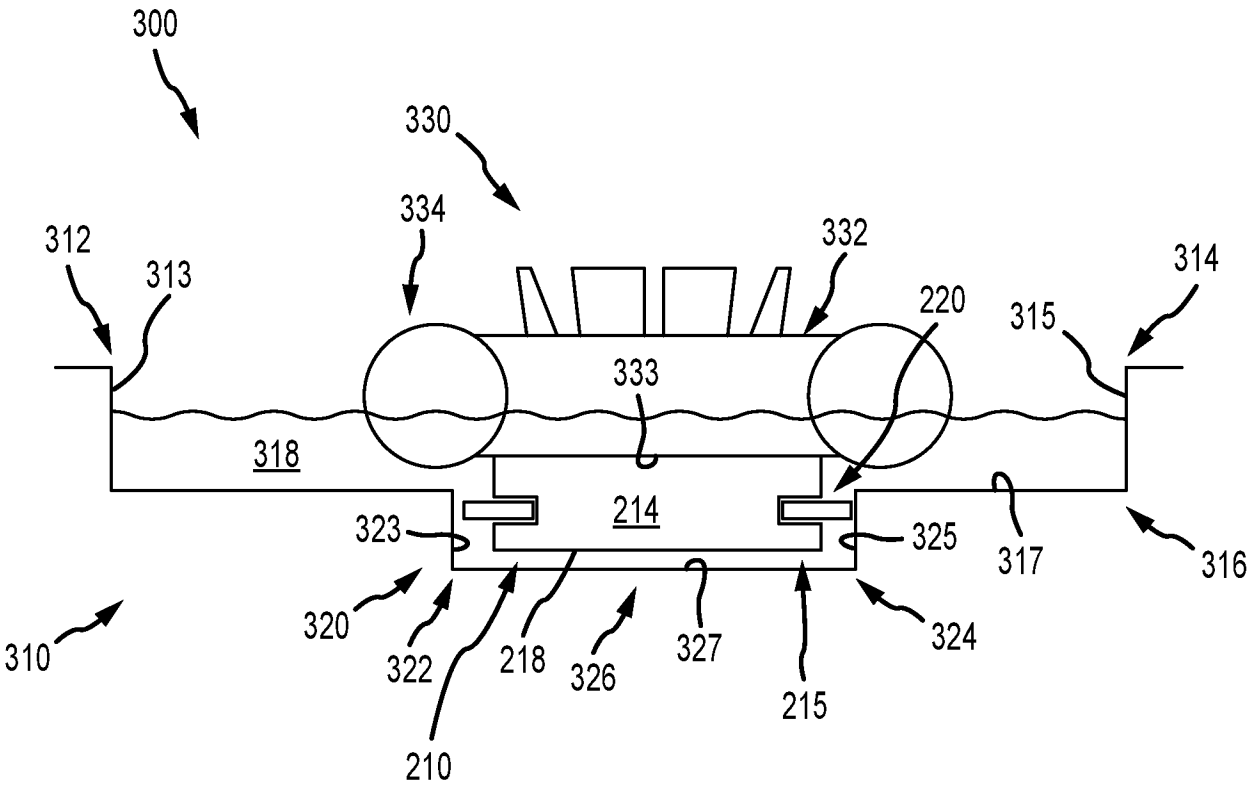
FIGS. 3A-3F illustrate end views of a raft ride system and a boat ride system, respectively, of the present description showing use of the guide bogie on a raft and a boat to provide guidance and frontward orientation and also show the boat ride system of FIG. 3B from side and top views with this forward vehicle orientation and side and top views after a change to a sideways vehicle orientation.
Figure 3B:
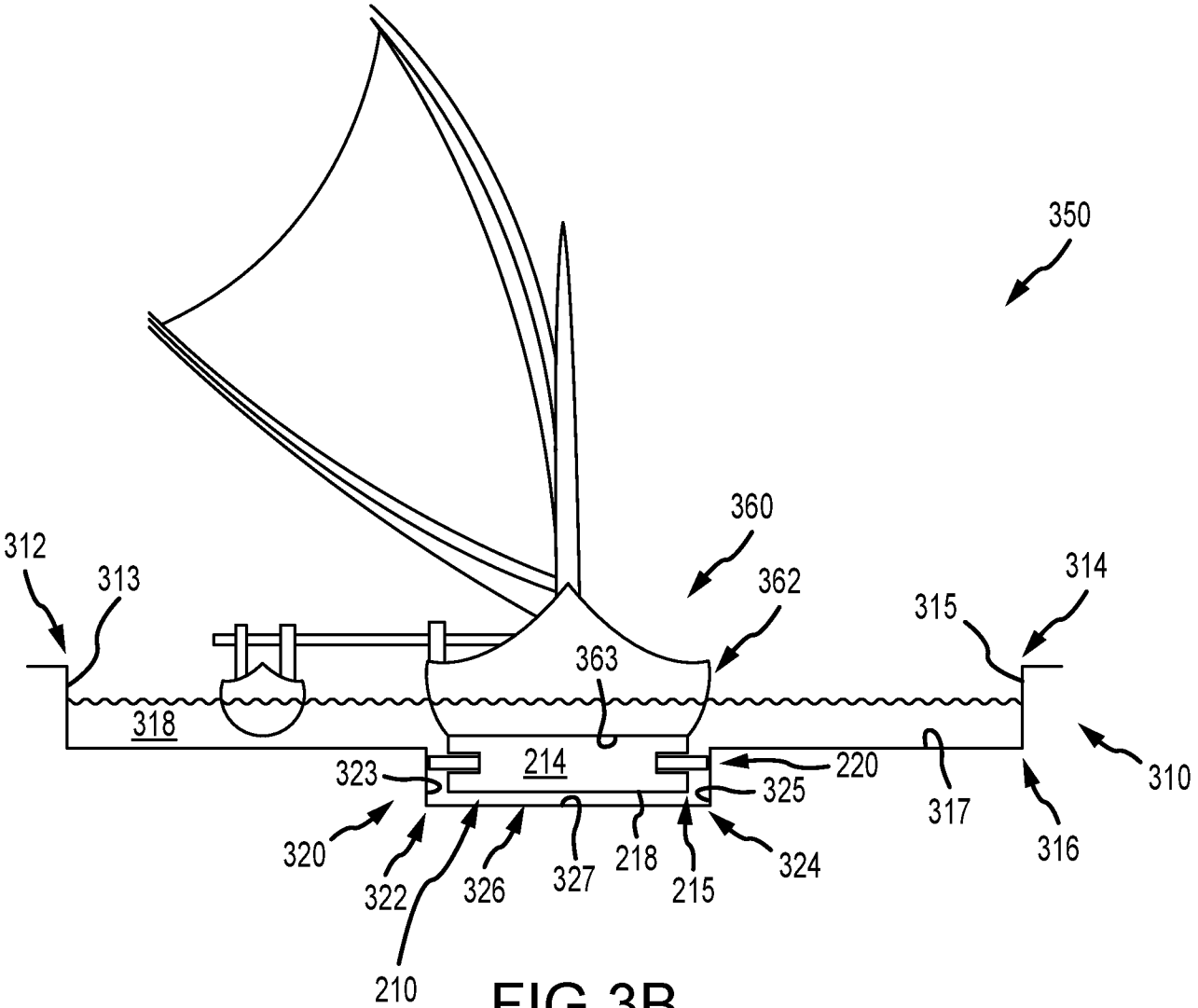

As shown in both FIGS. 3A and 3B, the ride systems 300 and 350 include a flume 310 for receiving and containing flowing water 318. The water 318 is contained in a channel defined by inner surfaces 313 and 315 of sidewalls 312 and 314 combined with the upper surface 317 of the bottom wall 316. Significantly, the ride systems 300 and 350 also include a guideway or track 320 in or on the bottom wall 316, and the guideway 320 is configured to receive floating passenger vehicles (rafts, boats, or the like) and to guide them along a ride path by defining their side-to-side travel (e.g., to retain a desired location relative to sidewalls 312, 314). The guideway 320 is adapted to receive the square guide bogie 210, and, to this end, the guideways 320 includes a pair of spaced apart sidewalls 322 and 324 providing inner contact or guide surfaces 323 and 325 that extend downward from the bottom flume surface 317 a predefined distance (e.g., a distance that allows a portion of the body 212 of the bogie 210 to be received and, typically, the entire width of the guide wheels 220). This distance typically will be in the range of 1 to 3 feet or more and be chosen to be large enough to provide a depth in the guideway 320 that ensures the bottom side 218 of the bogie body 212 is spaced apart from the upper surface 327 of the bottom wall 326 of the guideway 320 (e.g., with a minimum clearance during operation of 3 to 6 inches or more).

FIG. 3A shows a raft-based water ride system 300 with a single exemplary raft 330 shown in the flume 310. The raft 330 includes a body or passenger compartment 332 with a bottom surface or side 333 facing the bottom wall 316 of the flume 310. Further, the raft 330 includes an inflatable or buoyant bumper 334 extending about the periphery of the body 332 to facilitate the raft 330 floating on the flowing water 318 such that the bumper 334 is typically some distance above the upper surface 317 of the bottom wall 316 of the flume 310 during operations of the ride system 300. The width of the flume 310 as measured between inner surfaces 313 and 315 of sidewalls 312 and 314 is greater than the outer diameter of the bumper 334 such that there typically is no or limited contact between the guided raft 330 and the flume 310.

To guide and orient the raft 330, the bogie 210 is mounted on (or otherwise provided on) the raft with the top side 216 of the bogie body 212 abutting or proximate to the bottom side or surface 333 of the body 332 of the raft 330. During use as shown in FIG. 3A, the body 214 of the bogie 210 is received within the guideway 320. In this location in the flume 310, the guide wheels 220 at continuously or intermittently (e.g., with side-to-side movement of the raft 330) contact and roll upon one or both of the surfaces 323 and 325 of guideway sidewalls 322 and 324. This interaction causes the raft 330 to be guided in its location and travel along the flume 310 under the forces of the flowing water 318 and also to have its orientation/heading set (with a forwards orientation shown in FIG. 3A) as the bogie 210 cannot rotate (to any large amount) about its central axis as the width of the guideway 320 matches or is only a small amount larger than the outer dimensions of the square guide bogie 210. Hence, the rigidly interconnected body 332 of the raft 330 also cannot rotate or change its orientation while the bogie 210 rides within the guideway or track 320.

FIG. 3B shows a guided boat water ride system 350 with a single exemplary boat 360 shown in the flume 310. The boat 350 includes a body/hull (or passenger compartment 362 with a bottom surface or side 363 facing the bottom wall 316 of the flume 310. The hull 362 is designed and fabricated to enable the boat 360 to float in the flowing water 318 such that the bottom surface 363 is typically some distance above the upper surface 317 of the bottom wall 316 of the flume 310 during operations of the ride system 350. As with system 300, the width of the flume 310 as measured between inner surfaces 313 and 315 of sidewalls 312 and 314 is greater than the outermost dimensions of the boat 360 such that there typically is no or limited contact between the guided boat 360 and the flume 310.

To guide and orient the boat 360 (as discussed with reference to the raft 330 and FIG. 3A), the bogie 210 is mounted on (or otherwise provided on) the boat 360 with the top side 216 of the bogie body 212 abutting or proximate to the bottom side or surface 363 of the hull 362 of the boat 360. FIG. 3B shows the boat 360 being guided directionally (e.g., side-to-side movement in flume 310) and also oriented to have a forwards orientation in the flume 310 via interaction of the bogie 210 and the guideway 320.

Figure 3C:
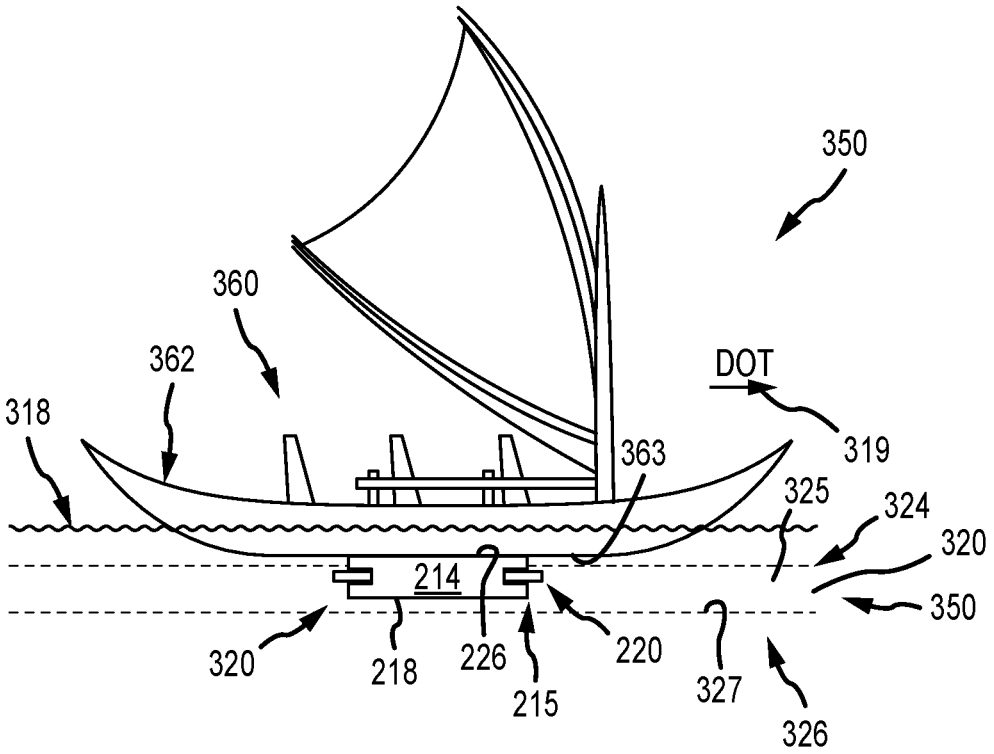
Figure 3D:
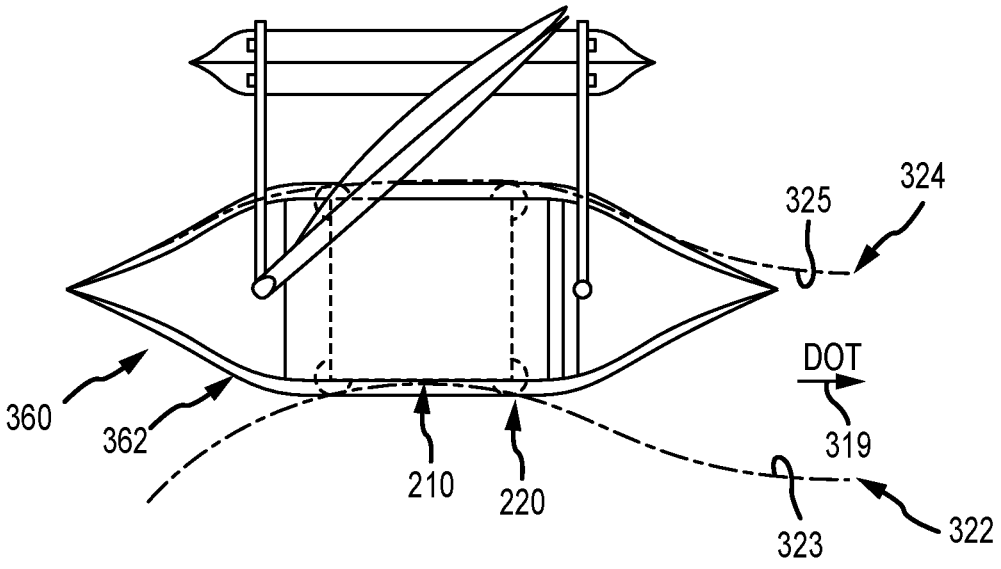
Figure 3E:
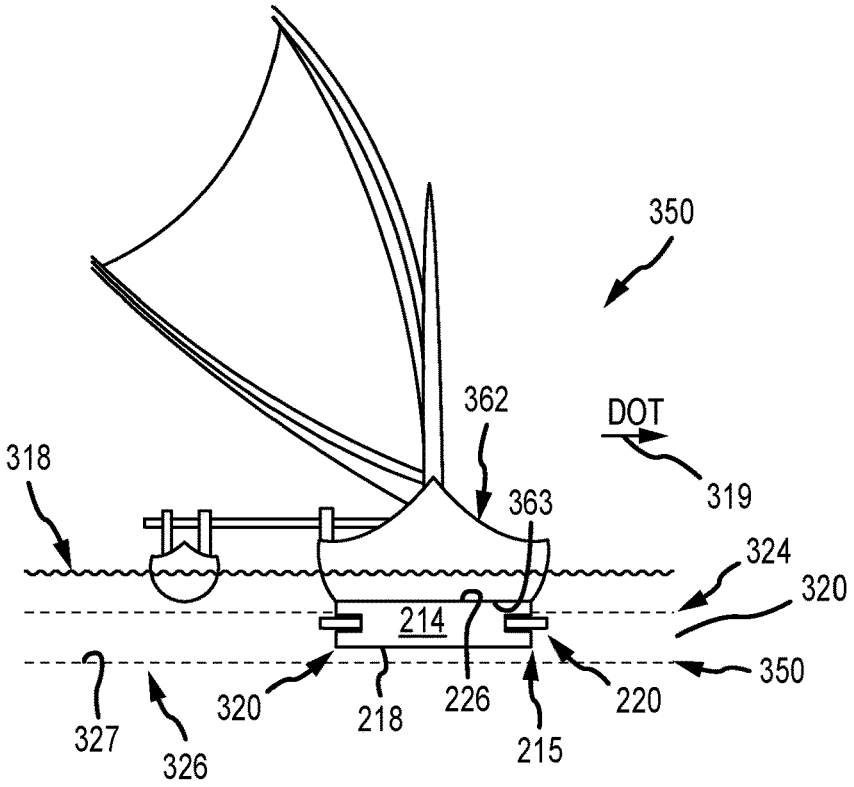
Figure 3F:
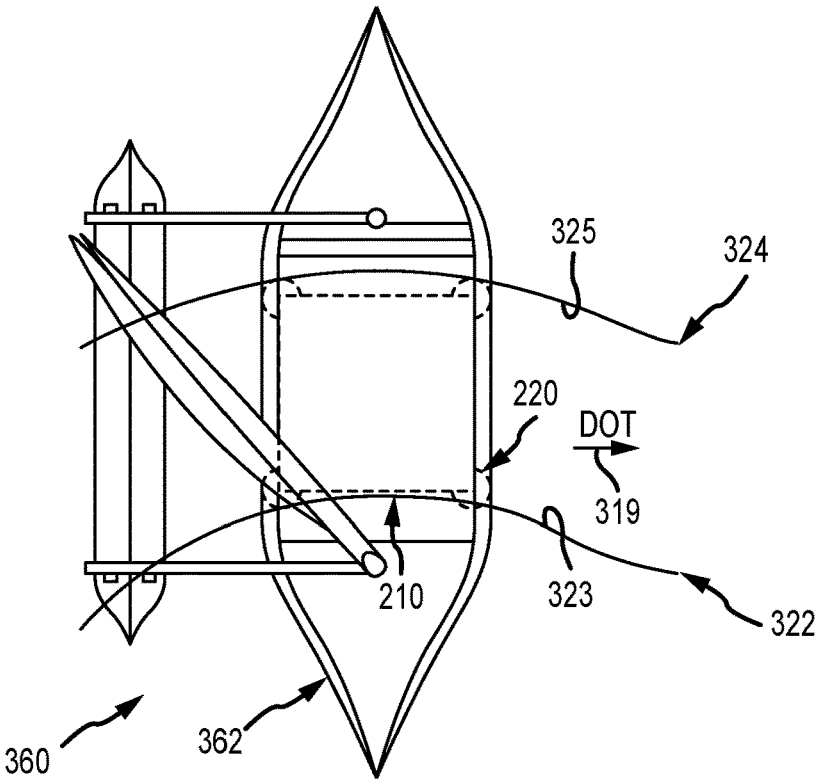

FIGS. 3C and 3D provide side and top views of the ride system 350 of FIG. 3B showing additional details of the boat 360, the bogie 210 mounted upon the boat hull 362, and its interaction with the guideway 320 of the flume 310 to provide directional guidance in the flume 310 and also to retain the forwards orientation as the boat 360 travels along the ride path in the DOT shown by arrow 319 that coincides with a direction of flowing water 318 in the flume 310. This orientation is retained until the boat 360 is acted upon by a boat rotation assembly (not shown in FIGS. 3A-3F but shown in FIG. 4-6), after which the orientation may be backwards, right sideways, or left sideways. For example, FIGS. 3E and 3F show side and top views of the boat 360 after it has been rotated 90 degrees, e.g., by a boat rotation assembly, to have a right sideways orientation. The bogie 210 acts along with the guideway 320 to retain this orientation (i.e., by limiting rotation about a center axis) as the boat 360 is also guided in its travels along the ride path of the flume 310 by the square guide bogie 210 with its guide wheels 220 rolling upon the surfaces 323, 325 of the guideway sidewalls 322, 324.

FIG. 4 illustrates a section of a flume 410, with flume extents 412 (defined by inner surfaces of sidewalls), of a water ride system 400 such as those shown in FIGS. 3A-3F. The rides system 400 includes a boat rotation assembly 431 with a secondary guideway or track 430, within the main guideway or track 420, that is designed to passively rotate or guide a boat from a first orientation to a second orientation using water flow 411. While not shown, the boat may take the form of boat/raft 330 or 350 or another configuration with a lower surface supporting the bogie 210 of FIGS. 2A and 2B. The guideway 420 is shown to include sidewalls 422, 424 with inward-facing or guide surfaces 423, 425, and guide wheels 220 of the guide bogie 210 mating with and rolling upon these surfaces 423, 425 so as to be directionally guided and to have rotation limited in the main guideway 420.

In a first section of the guideway, the bogie 210A is in a first operating state with a forwards orientation as indicated by arrow 211A. In this state, the bogie 210A causes a boat hull or body to which it is rigidly affixed to also have a forwards orientation. With further travel in the flume 410, the guide bogie 210B enters a second operating state in which its orientation is transitioning or rotating as shown with arrows 211B due to interaction with the secondary guideway 430 and the boat rotation assembly 431 that it contains until it is rotated as shown by arrow 439 by 90 degrees and exits this section in a third operating state of bogie 210C with a left sideways orientation as shown with arrow 211C. For ease of understanding rotations are illustrated herein as 90 degree counter-clockwise rotations, but embodiments can be readily adapted to provide larger or smaller rotational increments, and provide clockwise as well as counter-clockwise rotation The boat rotation assembly 431 is configured to be passive with no moving parts and to use the forces provided by the flowing water 411 in combination with configurations of the secondary guideway 430 to achieve the rotation 439 of the bogie 210B. As shown, the assembly 431 includes a wheel guide member 432 positioned within the guideway 430 with an arcuate wheel capturing surface facing one of the guideway walls 422. The guide member 432 may be teardrop shaped as shown or take a variety of other shapes, and its arcuate wheel capturing surface is spaced apart from the inner surface 423 of guideway sidewall 422 by a distance that matches or is a small amount (e.g., 1 to 3 inches or more) greater than an outer diameter of a guide wheel 220 on the guide bogie 210B. The shape of the wheel capturing surface and its location in the guideway 430 is chosen to define, with the surface 423 of guideway sidewall 422, a wheel passageway 435 in the guideway 430 to redirect travel of one of the guide bogie wheels 220 to cause the rotation 430 of the bogie body 212. The body 212 of the bogie 210 is configured to allow the member 432 to pass unobstructed through the body 212.

A leading wheel 220 of the bogie 210B contacts a leading edge of the arcuate wheel capturing surface of the guide member 432, which causes the wheel 220 to move into an inlet 434 to the wheel passageway 435 (with the captured wheel 220 rolling upon one or both the wall 422 and guide member 432). The passageway 435 has a 60 to 90 degree bend as shown in FIG. 4, and the captured wheel 220 follows this bend in passageway 435 until it is released from the passageway 435 via an outlet 436. With the change in direction of the captured wheel 220 in passageway 435, the forward momentum of the body 212 of the bogie 210 causes the body 212 to rotate about the axis of the captured wheel 220 (with other wheels rolling in some embodiments on a curved or sloped portion of inner surface 425 of opposite sidewall 424 of the guideway 420) until the body 212 has rotated 90 degrees upon its release from the boat rotation assembly 431 and the secondary guideway 430 as shown with arrow 211C for the guide bogie 210C in the next section of the flume 410. The bogie 210C will retain the left sideways orientation shown by arrow 211C in the main guideway 420 as does the boat supporting the bogie 210C until the next boat rotation assembly.

FIG. 5 illustrates another section of the flume 410 of a water ride system 500, such as those shown in FIGS. 3A-3F, that includes an alternative boat rotation assembly 531 with a secondary guideway or track 530. In this embodiment, the boat rotation assembly 531 provides one or more devices configured to slow movement of a wheel 220 of the guide bogie 210 to passively rotate or guide the boat attached to the bogie 210 from a first orientation to a second orientation (as shown, from a forwards orientation to a left sideways orientation) using water flow and speed reduction. As with FIG. 4, this can be seen from the three operating states of the bogie 210A, 210B, and 210C with orientations 211A, 211B, and 211C.

The boat rotation assembly 531 includes a wheel capture member 532 positioned in the secondary guideway 530 so as to present first and second curved surfaces facing an arcuate portion of the surface 423 of the sidewall 422. The member 532 is generally triangular in shape so that the two arcuate surfaces define a wheel passageway or channel 535 with an inlet 534 where a leading wheel 220 is captured and with an outlet 536 where the capture wheel 220 is released again into the main section of the guideway 420. The wheel passageway 535 also includes a 30 to 45 degree bend toward the sidewall 422 followed by a 30 to 45 degree bend away from the sidewall 422.

The assembly 531 further includes a plurality of devices 533 on the curved surface(s) of the member 532 and inner surface 423 of the guideway sidewall 422 that frictionally mate with the outer surfaces of the captured guide wheel 220. These act to slow the movement of the single captured wheel 220, which when combined with the DOT momentum of the bogie 210 (and attached boat) causes rotation 539 to change the orientation to a sideways orientation as shown with arrow 211C. The devices 533 may take a variety of forms, sizes, and number to achieve the desired amount of slowing or speed reduction, with some embodiments using brushes, tabs, and/or the like (which may be formed of plastic, rubber, or other materials).

FIG. 6 illustrates another section of the flume 410 of a water ride system 600, such as those shown in FIGS. 3A-3F, that includes a catch-and-release boat rotation assembly 632A, 632B (two operating states) in a secondary guideway or track 630 within main guideway 420, which is configured to actively rotate or guide the boat attached to the bogie 210 from a first orientation (shown with arrow 211A (to a second orientation (shown with arrow 211C via transitional orientations shown with arrow 211B). As shown, an arm 634 in a first state of assembly operations is provided that has a first end 635 in the flume 410 but outside the guideway 630. A second end 636, though, extends outward into the secondary guideway 630 so that a curved receiving/capturing surface 638 is provided in guideway 630 at a depth to be in the path of a leading guidewheel 220 of the bogie 210.

When the guide wheel 220 is captured by the arm 632A, the flow of water 411 and the DOT momentum of the bogie 210 (and attached boat) cause the bogie 210 to rotate as shown with arrow 639 about the captured wheel 220 (or its vertical rotation axis which may be at a corner 215 of the bogie 210). The catch and release boat rotation assembly of system 600 includes a curved recessed surface opposite the arm 632A in the surface 425 of the guideway sidewall 424 that allows the square bogie body 212 to have room to rotate 639 in the secondary guideway 630 or to be guided through wheel passageway 637 until rotation 639 is complete and orientation transitions 211B are completed to achieve the new orientation 211C for bogie 210C and attached boat. When the rotation 639 is completed (or during rotation 639 after the opposite wheel has passed the center point of the flume curve), the arm 634 is rotated (by an actuator, motor, or the like) as shown with arrow 633 about the inner end 635 (or about an pivot axle extending through this end 635) to place the assembly 632B in its second operating state with the arm 634 out of the secondary guideway 630 so as to release the captured wheel 220 and allow the bogie 210 (and attached boat) to continue floating in the DOT in the flowing water 411 with the new orientation 211C.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. A water ride system, comprising:

a flume for receiving and containing flowing water, wherein the flume includes first and second sidewalls and a bottom wall extending between lower edges of the first and second sidewalls;

within the flume, a boat with a hull, wherein the boat travels with the flowing water in a direction of travel (DOT) coinciding with a direction of flow of the flowing water;

only one guide bogie included on a lower surface of the hull of the boat, wherein a body of the guide bogie that pivotally supports a plurality of guide wheels is at least partially submerged in the flowing water; and a guideway provided on an upper surface of the bottom wall of the flume, the guideway including a pair of spaced-apart contact surfaces, wherein the guide wheels at least periodically contact and roll upon the contact surfaces of the guideway when the body of the guide bogie is received within the guideway while the boat travels along a ride path defined by the guideway in the DOT, and wherein the body has four sides with equal lengths to define a square cross sectional shape of the body.

2. The water ride system of claim 1, wherein the guide wheels extend outward a distance from each corner of the body.

3. The water ride system of claim 1, wherein the guide wheels are supported on the body to have a vertical rotation axis extending through or near corner of the body and wherein a pitch between adjacent pairs of the guide wheels has a single value.

4. The water ride system of claim 1, wherein the body of the guide bogie is limited from rotation by the contact surfaces and an orientation of the hull is retained in the guideway.

5. The water ride system of claim 4, wherein the flume includes a first section in which the orientation of the hull is a first one of forwards, backwards, left sideways, and right sideways and a second section in which the orientation of the hull is a second one of forwards, backwards, left sideways, and right sideways.

6. The water ride system of claim 1, wherein the guideway includes a secondary guideway and the water ride system further includes a boat rotation assembly rotating the body of the guide bogie 90 degrees within the secondary guideway to change an orientation of the hull from a first orientation upstream of the secondary guideway to a second orientation downstream of the secondary guideway.

7. The water ride system of claim 6, wherein the boat rotation assembly includes a guide member spaced apart from one of the contact surfaces defining a wheel passageway between the guide member and the one of the contact surfaces, wherein the wheel passageway is sized to receive a leading one of the guide wheels of the guide bogie, and wherein the wheel passageway defines a travel path for the received leading one of the guide wheels with a bend causing the body of the bogie to rotate under a momentum of the boat and the flow of the moving water to travel in the DOT in the flume.

8. The water ride system of claim 7, wherein the boat rotation assembly further includes at least one recessed surface in the contact surfaces for receiving one or more of the guide wheels during rotation of the body of the guide bogie in the secondary guideway.

9. The water ride system of claim 7, wherein the boat rotation assembly further comprises a plurality of devices in the wheel passageway for contacting the received leading one of the guide wheels configured to slow a speed of travel of the received leading one of the guide wheels in the wheel passageway.

10. The water ride system of claim 6, wherein the boat rotation assembly includes an arm rotatable by an actuator from a first position to position a surface of the arm into the secondary guideway into a path of a leading one of the guide wheels, whereby the leading one of the guide wheels is halted or slowed causing the body of the guide bogie to rotate in the secondary guideway, to a second position to move the surface of the arm out of the path of the leading one of the guide wheels, whereby the leading one of the guide wheels is released to move in the DOT.

11. A water ride system, comprising:

a flume for receiving and containing flowing water;

within the flume, a boat with a body;

only one guide bogie included on a lower surface of the body of the boat, wherein the guide bogie includes a body with a square cross sectional shape and guide-wheels pivotally mounted on or near each corner of the body; and a guideway provided on an upper surface of the bottom wall of the flume, the guideway including a pair of spaced-apart contact surfaces, wherein the guide wheels at least periodically contact and roll upon the contact surfaces of the guideway when the body of the guide bogie is received within the guide-way while the boat travels along a ride path defined by the guideway.

12. The water ride system of claim 11, wherein the guide wheels extend outward a distance from each corner of the body.

13. The water ride system of claim 11, wherein the guide wheels are supported on the body to have a vertical rotation axis extending through or near corner of the body and wherein a pitch between adjacent pairs of the guide wheels has a single value.

14. The water ride system of claim 11, wherein the body of the guide bogie is rigidly coupled with the body of the boat and is limited from rotation by the contact surfaces to retain an orientation of the boat.

15. The water ride system of claim 14, wherein the flume includes a first section in which the orientation of the hull is a first one of forwards, backwards, left sideways, and right sideways and a second section in which the orientation of the hull is a second one of forwards, backwards, left sideways, and right sideways.

16. The water ride system of claim 11, wherein the guideway includes a secondary guideway and the water ride system further includes a boat rotation assembly rotating the body of the guide bogie 90 degrees within the secondary guideway to change an orientation of the hull from a first orientation upstream of the secondary guideway to a second orientation downstream of the secondary guideway.

17. The water ride system of claim 16, wherein the boat rotation assembly includes a guide member spaced apart from one of the contact surfaces defining a wheel passageway between the guide member and the one of the contact surfaces, wherein the wheel passageway is sized to receive a leading one of the guide wheels of the guide bogie, and wherein the wheel passageway defines a travel path for the received leading one of the guide wheels with a bend causing the body of the bogie to rotate under a momentum of the boat to travel in the flume.

18. The water ride system of claim 17, wherein the boat rotation assembly further includes at least one recessed surface in the contact surfaces for receiving one or more of the guide wheels during rotation of the body of the guide bogie in the secondary guideway.

19. The water ride system of claim 17, wherein the boat rotation assembly further comprises a plurality of devices in the wheel passageway for contacting the received leading one of the guide wheels configured to slow a speed of travel of the received leading one of the guide wheels in the wheel passageway.

20. The water ride system of claim 16, wherein the boat rotation assembly includes an arm rotatable by an actuator from a first position to position a surface of the arm into the secondary guideway into a path of a leading one of the guide wheels, whereby the leading one of the guide wheels is halted or slowed causing the body of the guide bogie is rotated in the secondary guideway, to a second position to move the surface of the arm out of the path of the leading one of the guide wheels, whereby the leading one of the guide wheels is released.

21. A water ride system, comprising:

a flume for receiving and containing flowing water, wherein the flume includes first and second sidewalls and a bottom wall extending between lower edges of the first and second sidewalls;

within the flume, a boat with a hull, wherein the boat travels with the flowing water in a direction of travel (DOT) coinciding with a direction of flow of the flowing water;

only one guide bogie included on a lower surface of the hull of the boat, wherein a body of the guide bogie that pivotally supports a plurality of guide wheels is at least partially submerged in the flowing water; and a guideway provided on an upper surface of the bottom wall of the flume, the guideway including a pair of spaced-apart contact surfaces, wherein the guide wheels at least periodically contact and roll upon the contact surfaces of the guideway when the body of the guide bogie is received within the guide-way while the boat travels along a ride path defined by the guideway in the DOT, and wherein the body of the guide bogie is rigidly coupled to the hull and is limited from rotation by the contact surfaces and an orientation of the hull is retained in the guideway, and wherein the flume includes a first section in which the orientation of the hull is a first one of forwards, backwards, left sideways, and right sideways and a second section in which the orientation of the hull is a second one of forwards, backwards, left sideways, and right sideways.

22. The water ride system of claim 21, wherein the body has four sides with equal lengths to define a square cross sectional shape of the body, wherein the guide wheels extend outward a distance from each corner of the body, wherein the guide wheels are supported on the body to have a vertical rotation axis extending through or near corner of the body, and wherein a pitch between adjacent pairs of the guide wheels has a single value.

23. The water ride system of claim 21, wherein the guideway includes a secondary guideway and the water ride system further includes a boat rotation assembly rotating the body of the guide bogie 90 degrees within the secondary guideway to change an orientation of the hull from a first orientation upstream of the secondary guideway to a second orientation downstream of the secondary guideway.

24. The water ride system of claim 23, wherein the boat rotation assembly includes a guide member spaced apart from one of the contact surfaces defining a wheel passageway between the guide member and the one of the contact surfaces, wherein the wheel passageway is sized to receive a leading one of the guide wheels of the guide bogie, and wherein the wheel passageway defines a travel path for the received leading one of the guide wheels with a bend causing the body of the bogie to rotate under a momentum of the boat to travel in the DOT in the flume.

25. The water ride system of claim 24, wherein the boat rotation assembly further includes at least one recessed surface in the contact surfaces for receiving one or more of the guide wheels during rotation of the body of the guide bogie in the secondary guideway.

26. The water ride system of claim 24, wherein the boat rotation assembly further comprises a plurality of devices in the wheel passageway for contacting the received leading one of the guide wheels configured to slow a speed of travel of the received leading one of the guide wheels in the wheel passageway.

27. The water ride system of claim 23, wherein the boat rotation assembly includes an arm rotatable by an actuator from a first position to position a surface of the arm into the secondary guideway into a path of a leading one of the guide wheels, whereby the leading one of the guide wheels is halted or slowed causing the body of the guide bogie is rotated in the secondary guideway, to a second position to move the surface of the arm out of the path of the leading one of the guide wheels, whereby the leading one of the guide wheels is released to move in the DOT.

28. A water ride system, comprising:

a flume for receiving and containing flowing water, wherein the flume includes first and second sidewalls and a bottom wall extending between lower edges of the first and second sidewalls;

within the flume, a boat with a hull, wherein the boat travels with the flowing water in a direction of travel (DOT) coinciding with a direction of flow of the flowing water;

a guide bogie included on a lower surface of the hull of the boat, wherein a body of the guide bogie that pivotally supports a plurality of guide wheels is at least partially submerged in the flowing water, and wherein the body has four sides with equal lengths to define a square cross sectional shape of the body;

a guideway provided on an upper surface of the bottom wall of the flume, the guideway including a pair of spaced-apart contact surfaces and a secondary guideway, wherein the guide wheels at least periodically contact and roll upon the contact surfaces of the guideway when the body of the guide bogie is received within the guideway while the boat travels along a ride path defined by the guideway in the DOT; and a boat rotation assembly rotating the body of the guide bogie 90 degrees within the secondary guideway to change an orientation of the hull from a first orientation upstream of the secondary guideway to a second orientation downstream of the secondary guideway, wherein the boat rotation assembly includes a guide member spaced apart from one of the contact surfaces defining a wheel passageway between the guide member and the one of the contact surfaces, wherein the wheel passageway is sized to receive a leading one of the guide wheels of the guide bogie, and wherein the wheel passageway defines a travel path for the received leading one of the guide wheels with a bend causing the body of the bogie to rotate under a momentum of the boat and the flow of the moving water to travel in the DOT in the flume.

29. A water ride system, comprising:

a flume for receiving and containing flowing water, wherein the flume includes first and second sidewalls and a bottom wall extending between lower edges of the first and second sidewalls;

within the flume, a boat with a hull, wherein the boat travels with the flowing water in a direction of travel (DOT) coinciding with a direction of flow of the flowing water;

a guide bogie included on a lower surface of the hull of the boat, wherein a body of the guide bogie that pivotally supports a plurality of guide wheels is at least partially submerged in the flowing water, and wherein the body has four sides with equal lengths to define a square cross sectional shape of the body;

a guideway provided on an upper surface of the bottom wall of the flume, the guideway including a pair of spaced-apart contact surfaces and a secondary guideway, wherein the guide wheels at least periodically contact and roll upon the contact surfaces of the guideway when the body of the guide bogie is received within the guideway while the boat travels along a ride path defined by the guideway in the DOT; and a boat rotation assembly rotating the body of the guide bogie 90 degrees within the secondary guideway to change an orientation of the hull from a first orientation upstream of the secondary guideway to a second orientation downstream of the secondary guideway, wherein the boat rotation assembly includes an arm rotatable by an actuator from a first position to position a surface of the arm into the secondary guideway into a path of a leading one of the guide wheels, whereby the leading one of the guide wheels is halted or slowed causing the body of the guide bogie to rotate in the secondary guideway, to a second position to move the surface of the arm out of the path of the leading one of the guide wheels, whereby the leading one of the guide wheels is released to move in the DOT.

30. A water ride system, comprising:

a flume for receiving and containing flowing water;

within the flume, a boat with a body;

a guide bogie included on a lower surface of the body of the boat, wherein the guide bogie includes a body with a square cross sectional shape and guidewheels pivotally mounted on or near each corner of the body;

a guideway provided on an upper surface of the bottom wall of the flume, the guideway including a pair of spaced-apart contact surfaces and a secondary guideway, wherein the guide wheels at least periodically contact and roll upon the contact surfaces of the guideway when the body of the guide bogie is received within the guideway while the boat travels along a ride path defined by the guideway; and a boat rotation assembly rotating the body of the guide bogie 90 degrees within the secondary guideway to change an orientation of the hull from a first orientation upstream of the secondary guideway to a second orientation downstream of the secondary guideway, wherein the boat rotation assembly includes a guide member spaced apart from one of the contact surfaces defining a wheel passageway between the guide member and the one of the contact surfaces, wherein the wheel passageway is sized to receive a leading one of the guide wheels of the guide bogie, and wherein the wheel passageway defines a travel path for the received leading one of the guide wheels with a bend causing the body of the bogie to rotate under a momentum of the boat to travel in the flume.

31. A water ride system, comprising:

a flume for receiving and containing flowing water;

within the flume, a boat with a body;

a guide bogie included on a lower surface of the body of the boat, wherein the guide bogie includes a body with a square cross sectional shape and guidewheels pivotally mounted on or near each corner of the body;

a guideway provided on an upper surface of the bottom wall of the flume, the guideway including a pair of spaced-apart contact surfaces and a secondary guideway, wherein the guide wheels at least periodically contact and roll upon the contact surfaces of the guideway when the body of the guide bogie is received within the guideway while the boat travels along a ride path defined by the guideway; and a boat rotation assembly rotating the body of the guide bogie 90 degrees within the secondary guideway to change an orientation of the hull from a first orientation upstream of the secondary guideway to a second orientation downstream of the secondary guideway, wherein the boat rotation assembly includes an arm rotatable by an actuator from a first position to position a surface of the arm into the secondary guideway into a path of a leading one of the guide wheels, whereby the leading one of the guide wheels is halted or slowed causing the body of the guide bogie is rotated in the secondary guideway, to a second position to move the surface of the arm out of the path of the leading one of the guide wheels, whereby the leading one of the guide wheels is released.

32. A water ride system, comprising:

a flume for receiving and containing flowing water, wherein the flume includes first and second sidewalls and a bottom wall extending between lower edges of the first and second sidewalls;

within the flume, a boat with a hull, wherein the boat travels with the flowing water in a direction of travel (DOT) coinciding with a direction of flow of the flowing water, and wherein the flume includes a first section in which the orientation of the hull is a first one of forwards, backwards, left sideways, and right sideways, and a second section in which the orientation of the hull is a second one of forwards, backwards, left sideways, and right sideways;

a guide bogie included on a lower surface of the hull of the boat, wherein a body of the guide bogie that pivotally supports a plurality of guide wheels is at least partially submerged in the flowing water;

a guideway provided on an upper surface of the bottom wall of the flume, the guideway including a pair of spaced-apart contact surfaces and a secondary guideway, wherein the guide wheels at least periodically contact and roll upon the contact surfaces of the guideway when the body of the guide bogie is received within the guideway while the boat travels along a ride path defined by the guideway in the DOT, and wherein the body of the guide bogie is rigidly coupled to the hull and is limited from rotation by the contact surfaces and an orientation of the hull is retained in the guideway;

a boat rotation assembly rotating the body of the guide bogie 90 degrees within the secondary guideway to change the orientation of the hull from a first orientation upstream of the secondary guideway to a second orientation downstream of the secondary guideway, wherein the boat rotation assembly includes a guide member spaced apart from one of the contact surfaces defining a wheel passageway between the guide member and the one of the contact surfaces, wherein the wheel passageway is sized to receive a leading one of the guide wheels of the guide bogie, and wherein the wheel passageway defines a travel path for the received leading one of the guide wheels with a bend causing the body of the bogie to rotate under a momentum of the boat to travel in the DOT in the flume.

33. A water ride system, comprising:

a flume for receiving and containing flowing water, wherein the flume includes first and second sidewalls and a bottom wall extending between lower edges of the first and second sidewalls;

within the flume, a boat with a hull, wherein the boat travels with the flowing water in a direction of travel (DOT) coinciding with a direction of flow of the flowing water, and wherein the flume includes a first section in which the orientation of the hull is a first one of forwards, backwards, left sideways, and right sideways, and a second section in which the orientation of the hull is a second one of forwards, backwards, left sideways, and right sideways;

a guide bogie included on a lower surface of the hull of the boat, wherein a body of the guide bogie that pivotally supports a plurality of guide wheels is at least partially submerged in the flowing water;

a guideway provided on an upper surface of the bottom wall of the flume, the guideway including a pair of spaced-apart contact surfaces and a secondary guideway, wherein the guide wheels at least periodically contact and roll upon the contact surfaces of the guideway when the body of the guide bogie is received within the guideway while the boat travels along a ride path defined by the guideway in the DOT, and wherein the body of the guide bogie is rigidly coupled to the hull and is limited from rotation by the contact surfaces and an orientation of the hull is retained in the guideway;

a boat rotation assembly rotating the body of the guide bogie 90 degrees within the secondary guideway to change the orientation of the hull from a first orientation upstream of the secondary guideway to a second orientation downstream of the secondary guideway, wherein the boat rotation assembly includes an arm rotatable by an actuator from a first position to position a surface of the arm into the secondary guideway into a path of a leading one of the guide wheels, whereby the leading one of the guide wheels is halted or slowed causing the body of the guide bogie is rotated in the secondary guideway, to a second position to move the surface of the arm out of the path of the leading one of the guide wheels, whereby the leading one of the guide wheels is released to move in the DOT.

* * * * *